United States Patent [19]

Blees

[11] Patent Number: 4,881,819

[45] Date of Patent: Nov. 21, 1989

[54] METHOD AND APPARATUS FOR PREPARING CONCRETE MORTAR

[75] Inventor: Frederik C. Blees, Deventer, Netherlands

[73] Assignee: Deltracon Deventer B.V., Netherlands

[21] Appl. No.: 146,174

[22] Filed: Jan. 20, 1988

[30] Foreign Application Priority Data

Jan. 20, 1987 [NL] Netherlands ..... 8700131

[51] Int. Cl.[4] ..... B28C 7/04

[52] U.S. Cl. ..... 366/8; 366/17; 366/18; 366/19; 366/22; 366/40; 366/43; 366/140; 366/141; 366/142; 366/152; 366/177; 366/193

[58] Field of Search ..... 366/2, 16, 8, 17, 18, 366/33, 22, 20, 19, 21, 27, 29, 33, 34, 37, 40, 42, 43, 64, 65, 67, 160, 152, 182, 177, 193, 140, 141, 142, 144; 134/57 R

[56] References Cited

U.S. PATENT DOCUMENTS

| | | | |
|---|---|---|---|
| 2,791,120 | 7/1952 | Dietert . | |
| 2,854,714 | 10/1958 | Dietert | 134/57 R |
| 3,161,927 | 12/1964 | Dietert | 366/17 |
| 3,170,677 | 2/1965 | Phister | 366/16 |
| 3,172,175 | 3/1965 | Hartley | 366/17 X |
| 3,186,596 | 6/1965 | Badgett . | |
| 3,778,035 | 12/1973 | MacKinney . | |
| 4,245,915 | 1/1981 | Bracegirdle | 366/17 X |
| 4,335,966 | 6/1982 | Rapp et al. | 366/40 X |
| 4,569,025 | 2/1986 | Eirich et al. | 366/16 X |

FOREIGN PATENT DOCUMENTS

| | | |
|---|---|---|
| 796745 | 4/1936 | European Pat. Off. . |
| 1601107 | 9/1970 | European Pat. Off. . |
| 2258253 | 8/1975 | European Pat. Off. . |
| 12047 | 6/1980 | European Pat. Off. . |
| 468007 | 3/1969 | Fed. Rep. of Germany . |
| 2627904 | 1/1978 | Fed. Rep. of Germany . |

*Primary Examiner*—Harvey C. Hornsby
*Assistant Examiner*—K. O'Leary
*Attorney, Agent, or Firm*—John P. Snyder

[57] ABSTRACT

The invention relates to a method and apparatus for preparing concrete mortar. In order to regulate the moisture content of the concrete mortar a sand sample is taken of the sand used. This sand sample is dried. The amount of water added to a concrete charge is regulated subject to the weight difference of the sand sample prior to and after drying.

7 Claims, 1 Drawing Sheet

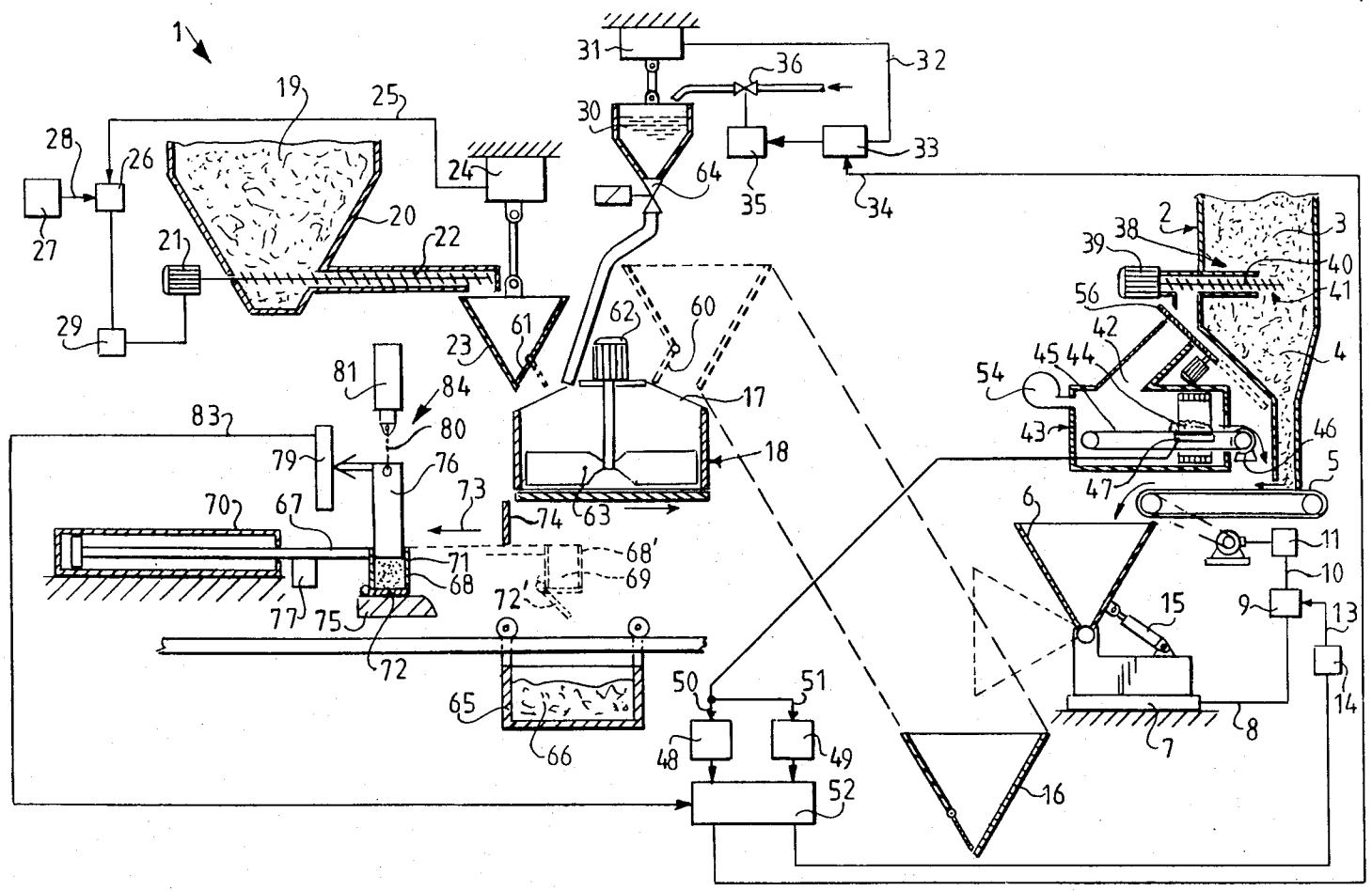

METHOD AND APPARATUS FOR PREPARING CONCRETE MORTAR

The invention relates to a method for preparation in series on production scale in at least one production concrete mixer of one concrete mixer charge of concrete mortar at a time, whereby a mixture comprising a dosed constituent of sand, a dosed constituent of binding agent and a dosed constituent of water is mixed, whereby a moisture measurement value is recorded and whereby the constituent of water is dosed depending on the recorded moisture measurement value.

Such a method is known. The moistness of the mixture is thereby recorded using resistance gauges located in the concrete mixer, and enough water is fed into the concrete mixer until the moisture measuring means indicate the value appropriate to the mix formula. This manner of preparing concrete is rather inaccurate, as a result of which the prepared concrete mortar frequently does not have the condition required for its purpose and the manufactured concrete products are of poor quality or in some cases the concrete products for manufacture cannot even be manufactured with the prepared concrete mortar at all. This is particularly a problem in the manufacture of concrete products of so-called earth-dry concrete mortar, whereby the forming template is removed almost immediately after forming of a green concrete element.

The invention has for its purpose to provide a method of the type referred to in the preamble, whereby with considerably greater containty concrete mortar is manufactured which has the condition desired in the mix formula. The condition of the prepared concrete mortar manifested by an uncertain factor of the moisture content of the sand used is eliminated. The sand sample is hereby preferably dried rapidly, which can take place in a microwave oven and/or with forced, preferably dry, hot air.

In the case of successive preparation of a series of concrete mortar charges, the measurement values of weight difference can be used for later concrete mixer charges. By extrapolating recorded measurement values of weight difference, even the moisture content of future samples can be predicted so that less demanding requirements need be set down in the speed of determining the measurement values of weight difference.

The invention is of particular importance because in practice the sand can have widely varying moisture contents. Even in one and the same sand bunker the moisture content can vary. The moisture content at the bottom of a sand bunker is often considerably higher than at the top.

The conditionn of the prepared concrete mortar is further affected in unpredictable manner by the granular distribution of the sand. The invention provides in this respect an improved method for preparing concrete mortar with the required condition in a more predictable manner.

The invention provides in addition an apparatus for performing the method according to the invention.

Mentioned and other features will be elucidated in the description following hereinafter with reference to a drawing.

The drawing shows in schematic form a preferred embodiment of the apparatus 1 according to the invention, comprising a sand bunker 2, in which is stored a supply of sand 3 and which is provied at its lower end with a sand discharge 4 which runs out above a conveyor belt 5 which can be driven periodically as required for periodic filling of a weigh hopper 6 which is arranged for tilting on a weighing balance 7. The sand weight value 8 of the balance 7 has a weight value output signal 8 that is fed to a comparer 9 so that the output signal 10 of comparer 9 controls a switch 11 for stopping the conveyor belt 5 and thus ending the filling of sand weigh hopper 6. Set in the comparer 9 is a mix formula sand weight value 13 which comes from a memory 14. When weigh hopper 6 is filled sufficiently it is tilted by means of a hydrocylinder 15 for emptying into a transporting bin 16 which is transported by lifting means (not shown) above the sand entry point 17 of a production concrete mixer 18.

Binder 19 is transported out of a binder bunker 20 by means of a screw conveyor 22 driven by a motor 21 which runs out above a binder weigh hopper 23 which is weighed by means of a weighing balance 24. The weight signal 25 thereof is fed to a comparer 26 in which it is compared with a mix formula binder signal 28 stored in a memory 27. When the required weight of binder has been supplied to the binder weigh hopper 23, control means 29 of motor 21 are initiated in order to stop motor 21 and therefore the transporting of the binder.

In addition a water weigh hopper 30 is carried by a water weighing balance 31, the water weight signal 32 from which is compared in a comparer 33 with a mix formula water signal 34. When the water weight signal 32 is equal to the mix formula water signal 34 control means 35 of a water feed valve 36 are initiated in order to stop the supply of water.

Sand bunker 3 is provided with sand sample-taking means 38 consisting of a screw conveyor 40 driven by a motor 39, the entrance to which is arranged lower down in sand bunker 3 on a location 41 for drawing off a sand sample. The outlet of screw conveyor 40 is situated above the entrance 42 to a sand sample drier 43 preferably consisting of a tunnel-like microwave oven in which each sand sample 44 is collected on a slack endless belt 45 which is driven periodically by an electric motor 46. The part of belt 45 carrying sand sample 44 is supported by a sand sample weighing balance 47. Immediately after entry of the sand sample an initial sand weight signal 50 is fed to a first memory 48. After sufficient drying time in which a fan 54 blows dry, preferably warm air through the switched on sand sample drier 43, an end sand weight signal 51 is fed to a second memory 49. In a calculator unit 52 the moisture content of said sample 44 is determined from both weighing signals 50 and 51 and the mix formula for the constituents to be fed into the production concrete mixer 18 is corrected to take this moisture content into account. This means that, assuming a moisture percentage x in the quantities of sand prescribed by the mix formula, when a moisture percentage of $x+dx$ is observed, the mix formula for this sand is adapted by addition of an extra sand weight percentage dx and the deduction of a water weight percentage.

The location 41 for drawing off a sand sample in sand bunker 2 is preferably chosen such that enough (for instance one) sand charges for concrete mixer charges have been processed such that directly after drying of sand sample 44 and the moisture percentage thereof being made available, the sand that was present around the sample draw-off location 41 at the moment of taking of the sample is poured into sand weigh hopper 6, so that when this filling operation is ended the calculated moisture percentage of the relevant sand sample is taken into account, since this data has been processed into the set value 13 of memory 14.

In like manner the calculated mix formula water signal 34, in which the moisture percentage of sand sample 44 has been taken into account, is fed to comparer 33 when a little later the water dosing takes place for the concrete mixer charge with sand in accordance with the relevant sand sample 44.

It is remarked that the sand sample 44 is drawn off each time directly after a sand charge has been removed from the sand bunker. It is conceivable that in each case exactly the quantity of a sand sample 44 is present in screw conveyor 40 and that the conveyor screw 40 is then emptied so that account is taken of the additional delay in the taking of the sand sample. Preferably however each time after a sand charge has been removed a sand sample 44 is drawn off by first guiding the sand present in conveyor screw 44 around the back via a baffle plate 56 pivoted between the conveyor screw outlet and the drier entry point 42 onto the conveyor 5 and shortly afterwards when the baffle plate 56 has been swivelled away to collect sand sample 44 in drier 43.

Should the concrete mixer process be faster than the drying process, a sand sample can then be taken occasionally and, by extrapolation of the measurement data of a number of sand samples 44, the probable moisture percentage of the relevant sand can be calculated and taken into account.

During each charging of the concrete mixer the sand and binder constituents are first poured into concrete mixer 18 by opening valves 60 and 61 of the transporting bin 16 and weigh hopper 23 respectively. Fillers, for example gravel and other dry substances, are poured into concrete mixer 18 as required according to mix formula. These dry substances are subsequently mixed by a mixer 63 driven by a motor 62, the water is then transferred from the weigh hopper 30 into concrete mixer 18 by opening of a valve 64, following which intensive mixing takes place. Finally, the thus prepared concrete mortar 66 is carried in a mortar transporting bin 65 or concrete mortar wagon to production locations where the necessary casing is disposed for the manufacture of concrete products. An earth-wet concrete mortar may thereby be required, with which, by vibrating the casings for a short time, green concrete elements can be manufactured from which the casings can be quickly removed.

During emptying of concrete mixer 18 a mortar sample holder 68 is held in the concrete mortar flow to collect a mortar sample 69. Holder 68 is attached to a rod 67 of a hydrocylinder 70 and consists of a vertical cylinder 71 with a bottom valve 72 which can be pivoted away. When the cylinder is withdrawn in the direction of arrow 73 the top side thereof is scraped off by a scraper plate 74. In withdrawn position above a platform 75 and beneath a compaction rate recorder 76 the holder 68 is set in vibration for a time by a vibrator member 77 and is then lowered by the compaction rate recorder formed by a weight connected to the movable tap of the potentiometer 79 so that when the weight is applied to the upper surface of the concrete mortar sample 69. The recorder changes 76 changes the resistance value of the potentiometer 79 at the same rate as compaction is taking place, since the movable tap of the potentiometer 79 potentiometer 79 is coupled to adjusted by the recorder 76. Recorder 76 is suspended via a slack element 80 (a cord) from a hydrocylinder 81.

After recording of the compaction rate the holder 68 is again placed in the concrete mortar sample taking position, whereby the treated sample is first unloaded with the valve 72 swivelled open into a transporting bin 65.

The output signal 83, that is, the compaction rate of the concrete mortar sample taking means 84 is fed to the calculator unit 52 for adapting of the mix formula to take into account the correction of the constituent of sand and/or the constituent of water 5 required for the relevant sand grain distribution.

If the compaction rate is too great, this means that there was relatively too much water and too little sand present in the concrete mortar sample. The following concrete mixer charges, of which it may be assumed that the sand grain distribution will be virtually the same, can then be prepared according to a corrected mix formula.

Although in preference measurement values of sand samples as well as of concrete mortar samples are taken into account in correction of the mix formula, it is conceivable to take only sand samples or only concrete mortar samples.

Although the water dosing preferably takes place using weigh means, it is also possible to do this using volume measurement or flow measurement.

The drying of the sample can be carried out in a microwave oven preferably with a per se known rotary wave distributor. The heating of the sample can however also be carried out with a radiation heater or other conventional heater. It is in any case recommended to spread the sand sample out each time into a thin layer and to employ a fan, preferably with pre-heated air, which stimulates the drying. Care must thereby be taken that the ventilating air cannot carry away any sand grains. In the case where the sand sample cannot be sufficiently dried in the concrete preparing period of a concrete charge, preferably two or, if necessary, more sand sample treating units are employed beside each other, preferably in one and the same drying space, whereby the sand draw-off location is selected so as to be in or near the sand bunker, taking into account the path of movement covered by the sand charge in the sand bunker, whereby the time interval of the drawing off of the sample and its processing is geared to the displacement time of the relevant sand charge from the sand sample draw-off location into the concrete mixer.

The weigh device of the sample handling device is arranged so as to be isolated and vibration-free, as this is usually necessary for accurate weighing.

The weighing balance is preferably wiped clean with a wiper and/or blown clean after each sample processing.

In order to eliminate weighing errors caused by grains of sand which may still remain on the weighing balance, at the beginning of each sample processing the weighing balance is always set to zero.

I claim:

1. The method of making a batch of concrete mortar from which a useful concrete element may be formed, which comprises the steps of:

a. providing a supply of sand which has a variable moisture content, b. providing a supply of binder, c. metering a quantity of the sand to provide a formulated weight of dry sand plus a weight amount of contained water due to the moisture content of the quantity of sand, d. drying a sample of the quantity of sand metered in step c and determining the difference in weight of the sample before and after drying, e. metering a quantity of binder until the quantity of binder equals a formulated weight of binder, f. metering a quantity of water in dependence upon the difference in weight determined in step d until the quantity of water plus the weight amount of contained water of step c equals a formulated weight of water, and g. intensively admixing the formulated weights of steps c-e until a batch of the concrete mortar is formed.

2. The method as defined in claim 1 including the steps of:

h. repeating steps c-g to form further batches of concrete mortar, and i. determining the weight difference as in step d for one batch and adjusting the quantity of metered water as in step f for a subsequent batch in dependence upon such weight difference.

3. Apparatus for making batches of concrete mortar, successive batches each containing a weight of dry sand, a weight of binder and a weight of water in which the weights are in a formulated weight ratio which when intensively mixed produces a concrete mortar from which useful concrete elements may be formed, which comprises:

means for providing a supply of sand which has a variable moisture content, means for providing a supply of binder, means for metering a quantity of the sand until the quantity of sand so metered equals the formulated weight of dry sand plus a weight amount of contained water due to the moisture content of the quantity of sand, means for metering a quantity of binder until the quantity of binder equals the formulated weight of binder, means for metering a quantity of water until the quantity of water plus the contained water of step c equals the formulated weight of water, means for sampling the ratio of sand to water, means for determining the quantity of sand and water required to be metered to provide the desired concrete mortar, means for adjusting the quantity of sand and water metered to provide the desired concrete mortar, means for intensively admixing the formulated weights until a batch of the concrete mortar is formed; and wherein said means for sampling the ratio of sand to water includes means for drying a portion of the metered quantity of sand and determining the weight difference of such portion before and after drying.

4. Apparatus as defined in claim 3 wherein said means for sampling the ratio of sand to water includes means for compacting a portion of the concrete mortar and determining the rate of compaction thereof.

5. Apparatus as defined in claim 4 wherein the means for compacting comprises a weight and a potentiometer having a movable tap to which the weight is connected.

6. Apparatus as defined in claim 3 in which the means for drying includes a forced air blower.

7. Apparatus as defined in claim 3 in which the means for drying also includes a microwave device.

* * * * *